US010117551B2

(12) United States Patent
Horvath et al.

(10) Patent No.: US 10,117,551 B2
(45) Date of Patent: Nov. 6, 2018

(54) HANDHELD VACUUM CLEANER

(71) Applicant: Techtronic Industries Co. Ltd., Tsuen Wan, New Territories (HK)

(72) Inventors: Jamie Horvath, Twinsburg, OH (US); Kevin L. Thomas, Silver Lake, OH (US); Ambreese Hill, Cleveland Heights, OH (US); Joseph Saunders, Wadsworth, OH (US); Justin C. Andrikanich, Stow, OH (US); William Nabors, Copley, OH (US)

(73) Assignee: Techtronic Industries Co. Ltd., Tsuen Wan, New Territories (HK)

( * ) Notice: Subject to any disclaimer, the term of this patent is extended or adjusted under 35 U.S.C. 154(b) by 366 days.

(21) Appl. No.: 14/920,170

(22) Filed: Oct. 22, 2015

(65) Prior Publication Data

US 2016/0113455 A1 Apr. 28, 2016

Related U.S. Application Data

(60) Provisional application No. 62/067,308, filed on Oct. 22, 2014.

(51) Int. Cl.
*A47L 5/24* (2006.01)
*A47L 5/26* (2006.01)
(Continued)

(52) U.S. Cl.
CPC ..... *A47L 5/24* (2013.01); *A47L 5/26* (2013.01); *A47L 9/12* (2013.01); *A47L 9/165* (2013.01);
(Continued)

(58) Field of Classification Search
CPC ..... A47L 5/24; A47L 5/36; A47L 9/16
See application file for complete search history.

(56) References Cited

U.S. PATENT DOCUMENTS 2,657,417 A 11/1953 Howard
2,986,765 A 6/1961 Ernolf et al.
(Continued)

FOREIGN PATENT DOCUMENTS

CA 2599303 2/2009
DE 19630286 1/1998
(Continued)

OTHER PUBLICATIONS

International Search Report and Written Opinion for Application No. PCT/US2015/056922 dated Feb. 5, 2016 (13 pages).

*Primary Examiner* — Michael Jennings
(74) *Attorney, Agent, or Firm* — Michael Best & Friedrich LLP

(57) ABSTRACT

A handheld vacuum cleaner including a housing having a front end, a back end, a first side, and a second side, a handle having a longitudinal axis that extends in a direction toward the front and back ends of the housing, a suction source, and a cyclonic separator. The cyclonic separator includes a cylindrical wall having a first end and a second end, a first end wall located at the first end of the cylindrical wall, a dirty air inlet, a clean air outlet, a debris outlet adjacent the second end of the cylindrical wall, and a longitudinal axis surrounded by the cylindrical wall and the longitudinal axis of the cyclonic separator extends in a direction toward the first and second sides of the housing. The housing includes an aperture that extends through the first side, and the first end wall of the cyclonic separator is removable through the aperture.

27 Claims, 5 Drawing Sheets

(51) Int. Cl.
*A47L 9/16* (2006.01)
*A47L 9/12* (2006.01)
*A47L 9/28* (2006.01)

(52) U.S. Cl.
CPC ..... *A47L 9/1608* (2013.01); *A47L 9/1658* (2013.01); *A47L 9/1683* (2013.01); *A47L 9/1691* (2013.01); *A47L 9/2884* (2013.01)

(56) References Cited

U.S. PATENT DOCUMENTS 4,268,288 A 5/1981 Coombs
4,403,372 A 9/1983 Keane et al.
4,789,476 A 12/1988 Schulz
4,853,008 A 8/1989 Dyson
5,350,432 A 9/1994 Lee
5,779,745 A 7/1998 Kilstrom
5,935,279 A 8/1999 Kilstrom
5,950,274 A 9/1999 Kilstrom
6,003,196 A 12/1999 Wright et al.
6,129,775 A 10/2000 Conrad et al.
6,141,826 A 11/2000 Conrad et al.
6,168,641 B1 1/2001 Tuvin et al.
6,168,716 B1 1/2001 Conrad et al.
6,173,474 B1 1/2001 Conrad
6,195,835 B1 * 3/2001 Song ..... A47L 9/104 15/327.1
6,221,134 B1 4/2001 Conrad et al.
6,228,151 B1 5/2001 Conrad et al.
6,228,260 B1 5/2001 Conrad et al.
6,231,645 B1 5/2001 Conrad et al.
6,251,296 B1 6/2001 Conrad et al.
6,277,278 B1 8/2001 Conrad et al.
6,306,199 B1 10/2001 Gustafson et al.
6,312,594 B1 11/2001 Conrad et al.
6,334,234 B1 1/2002 Conrad et al.
6,344,064 B1 2/2002 Conrad
6,350,292 B1 2/2002 Lee et al.
6,391,095 B1 5/2002 Conrad et al.
6,398,834 B2 6/2002 Oh
6,406,505 B1 6/2002 Oh et al.
6,419,719 B2 7/2002 Conrad et al.
6,432,154 B2 8/2002 Oh et al.
6,440,197 B1 8/2002 Conrad et al.
6,482,246 B1 11/2002 Dyson et al.
6,485,536 B1 11/2002 Masters
6,502,277 B1 1/2003 Petersson et al.
6,502,278 B2 * 1/2003 Oh ..... A47L 9/1633 15/352
6,519,804 B1 * 2/2003 Vujik ..... A47L 5/32 15/331
6,532,620 B2 * 3/2003 Oh ..... A47L 5/28 15/350
6,533,834 B2 3/2003 Conrad et al.
6,536,073 B2 3/2003 Uratani et al.
6,546,593 B2 * 4/2003 Oh ..... A47L 5/28 15/353
6,553,612 B1 4/2003 Dyson et al.
6,553,613 B2 4/2003 Onishi et al.
6,558,453 B2 5/2003 Sepke et al.
6,562,093 B2 5/2003 Oh
6,572,668 B1 6/2003 An et al.
6,578,230 B2 6/2003 Park et al.
6,579,334 B2 6/2003 Oh et al.
6,582,489 B2 6/2003 Conrad
6,588,051 B2 7/2003 Hashizume et al.
6,589,309 B2 7/2003 Oh et al.
6,596,045 B2 7/2003 Qian
6,596,046 B2 7/2003 Conrad et al.
6,596,047 B2 7/2003 Oh
6,599,338 B2 7/2003 Oh et al.
6,599,339 B2 7/2003 Oh
6,599,340 B2 7/2003 Conrad et al.
6,607,572 B2 8/2003 Gammack et al.
6,607,575 B2 8/2003 Oh et al.
6,613,116 B2 9/2003 Oh
6,613,129 B2 9/2003 Gen
6,616,721 B2 9/2003 Oh
6,623,539 B2 9/2003 Lee et al.
6,625,845 B2 9/2003 Matsumoto et al.
6,640,385 B2 * 11/2003 Oh ..... A47L 9/1683 15/352
6,648,934 B2 11/2003 Choi et al.
6,660,053 B2 12/2003 Oh et al.
6,662,403 B2 12/2003 Oh
6,679,930 B1 1/2004 An et al.
6,702,868 B2 3/2004 Oh et al.
6,706,095 B2 3/2004 Morgan
6,709,495 B1 3/2004 Storer
6,712,868 B2 3/2004 Murphy et al.
6,732,405 B2 5/2004 Oh
6,732,406 B2 5/2004 Oh
6,735,816 B2 5/2004 Oh et al.
6,736,873 B2 5/2004 Conrad et al.
6,746,500 B1 6/2004 Park et al.
6,757,933 B2 7/2004 Oh et al.
6,766,557 B2 7/2004 Park et al.
6,766,558 B1 7/2004 Matsumoto et al.
6,782,583 B2 8/2004 Oh
6,782,585 B1 8/2004 Conrad et al.
6,810,557 B2 11/2004 Hansen et al.
6,810,558 B2 11/2004 Lee
6,811,584 B2 11/2004 Oh
6,818,033 B2 11/2004 North
6,818,036 B1 11/2004 Seaman
6,824,580 B2 11/2004 Oh
6,833,015 B2 12/2004 Oh et al.
6,835,222 B2 12/2004 Gammack
6,840,972 B1 1/2005 Kim
6,857,165 B2 2/2005 Oh
6,868,578 B1 3/2005 Kasper et al.
6,874,197 B1 4/2005 Conrad et al.
6,896,711 B2 5/2005 Oh
6,901,626 B2 6/2005 Bair et al.
6,902,596 B2 6/2005 Conrad et al.
6,916,351 B2 7/2005 Oh
6,925,680 B2 8/2005 Oh
6,928,692 B2 8/2005 Oh et al.
6,948,212 B2 9/2005 Oh et al.
6,951,045 B2 10/2005 Thur et al.
6,968,596 B2 11/2005 Oh et al.
6,974,488 B2 12/2005 Dyson
6,977,003 B2 12/2005 Lim et al.
6,989,039 B2 1/2006 Vujik
6,991,666 B2 1/2006 Organ
6,994,740 B2 2/2006 Gammack et al.
7,014,671 B2 3/2006 Oh
7,022,154 B2 4/2006 Oh
7,065,826 B1 6/2006 Arnold
7,074,248 B2 7/2006 Jin et al.
7,086,119 B2 8/2006 Go et al.
7,097,680 B2 8/2006 Oh
7,105,034 B2 9/2006 Jung et al.
7,105,035 B2 9/2006 Oh et al.
7,114,216 B2 10/2006 Stephens et al.
7,128,770 B2 10/2006 Oh et al.
7,140,068 B1 11/2006 Vander Baan et al.
7,152,276 B2 12/2006 Jin et al.
7,152,777 B2 12/2006 Jung et al.
7,160,346 B2 1/2007 Park
7,162,770 B2 1/2007 Davidshofer
7,163,568 B2 1/2007 Sepke et al.
7,169,201 B2 1/2007 Oh et al.
7,171,725 B2 2/2007 Sjoberg et al.
7,188,388 B2 3/2007 Best et al.
7,210,192 B2 5/2007 Ito et al.
7,228,592 B2 6/2007 Hawkins et al.
7,247,181 B2 7/2007 Hansen et al.
7,261,754 B2 8/2007 Oh et al.
7,273,506 B2 9/2007 Oh et al.
7,276,099 B2 10/2007 Hayashi et al.
7,288,129 B2 10/2007 Oh et al.
7,291,190 B2 11/2007 Dummelow
7,291,193 B2 11/2007 Oh et al.

(56) References Cited

U.S. PATENT DOCUMENTS 7,293,326 B2 11/2007 Hawkins et al.
7,294,159 B2 11/2007 Oh et al.
7,297,172 B2 11/2007 Lee
7,309,368 B2 12/2007 Oh et al.
7,326,268 B2 2/2008 Oh et al.
7,329,295 B2 2/2008 Greene et al.
7,331,084 B2 2/2008 Oh
7,332,008 B2 2/2008 Oh et al.
7,334,290 B2 2/2008 Hawkins et al.
7,335,241 B2 2/2008 Oh et al.
7,335,242 B2 2/2008 Oh
7,341,611 B2 3/2008 Greene et al.
7,343,643 B2 3/2008 Kondo
7,354,468 B2 4/2008 Arnold et al.
7,361,200 B2 4/2008 Oh et al.
7,377,007 B2 5/2008 Best
7,377,953 B2 5/2008 Oh
7,381,233 B2 6/2008 Oh et al.
7,381,234 B2 6/2008 Oh
7,381,236 B2 6/2008 Lee et al.
7,381,247 B2 6/2008 Han et al.
7,381,248 B2 6/2008 Kim et al.
7,395,579 B2 7/2008 Oh
7,398,578 B2 7/2008 Lee
7,404,231 B2 7/2008 Kang
7,407,524 B2 8/2008 Han et al.
7,409,744 B2 8/2008 Go et al.
7,410,517 B2 8/2008 Han et al.
7,410,535 B2 8/2008 Song et al.
7,416,575 B2 8/2008 Oh et al.
7,419,521 B2 9/2008 Oh et al.
7,419,522 B2 9/2008 Arnold
7,419,523 B2 9/2008 Sjöberg et al.
7,422,614 B2 9/2008 Sepke et al.
7,422,615 B2 9/2008 Kim
7,429,284 B2 9/2008 Oh et al.
7,438,737 B2 10/2008 Song et al.
7,448,146 B2 11/2008 Cho et al.
7,449,039 B2 11/2008 Hong et al.
7,449,040 B2 11/2008 Conrad et al.
7,455,708 B2 11/2008 Conrad et al.
7,462,212 B2 12/2008 Han et al.
7,470,299 B2 12/2008 Han et al.
7,473,289 B2 1/2009 Oh et al.
7,475,449 B2 1/2009 Lee
7,479,172 B2 1/2009 Ivarsson
7,479,173 B2 1/2009 Ivarsson et al.
7,481,860 B2 1/2009 Ivarsson
7,485,164 B2 2/2009 Jeong et al.
7,491,255 B2 2/2009 Jung
7,494,523 B2 2/2009 Oh et al.
7,497,899 B2 3/2009 Han et al.
7,501,002 B2 3/2009 Han et al.
7,513,924 B2 4/2009 French et al.
7,534,279 B2 5/2009 Oh et al.
7,537,625 B2 5/2009 Han et al.
7,544,224 B2 6/2009 Tanner et al.
7,544,226 B2 6/2009 Oh
7,547,336 B2 6/2009 Fester et al.
7,547,337 B2 6/2009 Oh et al.
7,547,338 B2 6/2009 Kim et al.
7,547,351 B2 6/2009 Oh et al.
7,555,808 B2 7/2009 Oh et al.
7,556,661 B2 7/2009 Jeong et al.
7,556,662 B2 7/2009 Lee et al.
7,559,963 B2 7/2009 Oh et al.
7,559,964 B2 7/2009 Oh et al.
7,559,965 B2 7/2009 Oh et al.
7,563,296 B2 7/2009 Ni
7,563,297 B2 7/2009 Kim
7,563,298 B2 7/2009 Oh
7,565,853 B2 7/2009 Arnold et al.
7,582,128 B2 9/2009 Hwang et al.
7,582,129 B2 9/2009 Kim et al.
7,594,943 B2 9/2009 Oh et al.
7,594,944 B2 9/2009 Oh
7,594,945 B2 9/2009 Kim et al.
7,597,730 B2 10/2009 Yoo et al.
7,604,674 B2 10/2009 Han et al.
7,604,675 B2 10/2009 Makarov et al.
7,611,558 B2 11/2009 Oh et al.
7,615,089 B2 11/2009 Oh
7,618,470 B2 11/2009 Eddington et al.
7,628,831 B2 12/2009 Gomiciaga-Pereda et al.
7,628,832 B2 12/2009 Sepke et al.
7,628,833 B2 12/2009 Oh
7,632,324 B2 12/2009 Makarov et al.
7,632,327 B2 12/2009 Yoo
7,635,400 B2 12/2009 Yoo
7,637,973 B2 12/2009 Oh et al.
7,637,991 B2 12/2009 Eddington et al.
7,645,311 B2 1/2010 Oh et al.
7,651,544 B1 1/2010 Fester et al.
7,662,201 B2 2/2010 Lee
7,662,202 B2 2/2010 Oh et al.
7,678,166 B2 3/2010 Yoo et al.
7,682,412 B2 3/2010 Oh
7,686,858 B2 3/2010 Oh
7,686,861 B2 3/2010 Oh
7,691,161 B2 4/2010 Oh et al.
7,704,290 B2 4/2010 Oh
7,708,789 B2 5/2010 Fester
7,708,791 B2 5/2010 Oh et al.
7,708,808 B1 5/2010 Heumann
7,717,973 B2 5/2010 Oh et al.
7,722,693 B2 5/2010 Yoo et al.
7,731,770 B2 6/2010 Strutt et al.
7,740,675 B2 6/2010 Conrad
7,743,461 B2 6/2010 Carr et al.
7,744,667 B2 6/2010 Oh et al.
7,744,668 B2 6/2010 Oh et al.
7,748,079 B2 7/2010 McDowell et al.
7,749,293 B2 7/2010 Conrad
7,749,296 B2 7/2010 Han et al.
7,763,090 B2 7/2010 Gomiciaga-Pereda et al.
7,770,256 B1 8/2010 Fester
7,771,499 B2 8/2010 Oh et al.
7,776,115 B2 8/2010 Oh et al.
7,776,116 B2 8/2010 Oh et al.
7,776,120 B2 8/2010 Conrad
7,776,121 B2 8/2010 Yun et al.
7,780,752 B2 8/2010 Cha et al.
7,785,381 B2 8/2010 Oh et al.
7,785,383 B2 8/2010 Oh et al.
7,789,922 B1 9/2010 Wai
7,789,923 B2 9/2010 Oh et al.
7,794,515 B2 9/2010 Oh et al.
7,803,205 B2 9/2010 Oh et al.
7,803,207 B2 9/2010 Conrad
7,806,950 B2 10/2010 Han et al.
7,811,345 B2 10/2010 Conrad
7,811,349 B2 10/2010 Nguyen
7,819,933 B2 10/2010 Moon et al.
7,828,866 B2 11/2010 Courtney et al.
7,841,477 B2 11/2010 Hansen
7,854,779 B2 12/2010 Oh
7,854,782 B2 12/2010 Oh et al.
7,862,637 B2 1/2011 Han et al.
7,867,306 B2 1/2011 Courtney et al.
7,867,307 B2 1/2011 Bates et al.
7,867,308 B2 1/2011 Conrad
7,874,040 B2 1/2011 Follows et al.
7,879,120 B2 2/2011 Seo et al.
7,879,121 B2 2/2011 Oh
7,879,142 B2 2/2011 Han et al.
7,882,592 B2 2/2011 Hwang et al.
7,882,593 B2 2/2011 Beskow et al.
7,887,612 B2 2/2011 Conrad
7,887,613 B2 2/2011 Ruben
7,907,680 B2 3/2011 Tsai et al.
7,908,706 B2 3/2011 Hawkins et al.
7,914,609 B2 3/2011 Sullivan et al.
7,918,909 B2 4/2011 McDowell
7,922,794 B2 4/2011 Morphey

(56) References Cited

U.S. PATENT DOCUMENTS 7,931,717 B2 4/2011 Conrad
7,931,722 B2 4/2011 Sepke et al.
7,938,872 B2 5/2011 Blossey et al.
7,941,895 B2 5/2011 Conrad
7,951,216 B2 5/2011 Ha et al.
7,951,218 B2 5/2011 Oh
7,966,692 B2 6/2011 Kim
7,967,884 B2 6/2011 Sepke et al.
7,981,181 B2 7/2011 Yoo
7,992,252 B2 8/2011 Park et al.
7,996,956 B2 8/2011 Wood et al.
7,996,957 B2 8/2011 Kah, Jr.
7,998,260 B2 8/2011 Ni
8,015,659 B2 9/2011 Conrad et al.
8,020,707 B2 9/2011 Kim et al.
8,021,453 B2 9/2011 Howes
8,034,140 B2 10/2011 Conrad
8,048,180 B2 11/2011 Oh et al.
8,048,183 B2 11/2011 Conrad
8,062,398 B2 11/2011 Luo et al.
8,097,057 B2 1/2012 Arnold
8,100,999 B2 1/2012 Ashbee et al.
8,146,201 B2 4/2012 Conrad
8,151,407 B2 4/2012 Conrad
8,152,877 B2 4/2012 Greene
8,152,878 B2 4/2012 McLeod
8,152,883 B2 4/2012 Lee
8,161,597 B2 4/2012 Witter et al.
8,161,599 B2 4/2012 Griffith et al.
8,167,964 B2 5/2012 Wai
8,176,597 B2 5/2012 Stein et al.
8,182,563 B2 5/2012 Horne et al.
8,186,006 B2 5/2012 Hyun et al.
8,192,515 B2 6/2012 Conrad
8,209,815 B2 7/2012 Makarov et al.
8,250,702 B2 8/2012 Conrad
8,252,096 B2 8/2012 Horne
8,268,029 B2 9/2012 Yoo
8,282,697 B2 10/2012 Oh
8,292,979 B2 10/2012 Conrad
8,302,250 B2 11/2012 Dyson et al.
8,302,252 B2 11/2012 Hyun et al.
8,302,253 B2 11/2012 Ni
8,316,507 B2 11/2012 Hyun et al.
8,348,605 B2 1/2013 de Broqueville
8,349,428 B2 1/2013 Conrad
8,361,179 B2 1/2013 Guerry et al.
8,375,509 B2 2/2013 Bates et al.
8,409,335 B2 4/2013 Dyson et al.
8,419,835 B2 4/2013 Krishnamurthy et al.
8,425,642 B2 4/2013 Worker et al.
8,448,291 B2 5/2013 Conrad
8,448,292 B2 5/2013 Miefalk et al.
8,479,358 B2 7/2013 Conrad
8,484,799 B2 7/2013 Conrad
8,486,170 B2 7/2013 Conrad et al.
8,495,789 B2 7/2013 Nicolaou et al.
8,499,411 B2 8/2013 Tran et al.
8,510,907 B2 8/2013 Conrad
8,528,160 B2 9/2013 Conrad
8,528,163 B2 9/2013 Park et al.
8,528,164 B2 9/2013 Conrad
8,533,903 B2 9/2013 Muhlenkamp et al.
8,533,904 B2 9/2013 Conrad
8,561,257 B2 10/2013 Conrad
8,562,705 B2 10/2013 Courtney et al.
8,567,005 B2 10/2013 Conrad
8,567,006 B2 10/2013 Conrad
8,567,008 B2 10/2013 Conrad
8,568,500 B2 10/2013 Han et al.
8,572,789 B2 11/2013 Horne
8,578,550 B2 11/2013 Conrad
8,578,553 B2 11/2013 Conrad
8,578,555 B2 11/2013 Conrad
8,590,102 B2 11/2013 Conrad
8,601,641 B2 12/2013 Conrad
8,607,406 B2 12/2013 Miefalk et al.
8,607,407 B2 * 12/2013 Conrad ..... A47L 5/24 15/344
8,613,125 B2 12/2013 Jeong et al.
8,621,709 B2 1/2014 Conrad
8,631,538 B2 1/2014 Huffman
8,640,303 B2 2/2014 Conrad
8,640,304 B2 2/2014 Conrad
8,646,146 B2 2/2014 Conrad
8,646,147 B2 2/2014 Conrad
8,646,148 B2 2/2014 Sunderland et al.
8,646,149 B2 2/2014 Conrad
8,646,849 B2 2/2014 Crawford et al.
8,657,903 B2 2/2014 Menssen
8,659,184 B2 2/2014 Conrad
8,661,607 B2 3/2014 Hwang et al.
8,661,611 B2 3/2014 Oh
8,667,640 B2 3/2014 Conrad
8,677,554 B2 3/2014 Conrad
8,677,558 B2 3/2014 Conrad
8,683,644 B2 4/2014 Conrad
8,689,395 B2 4/2014 Conrad
8,689,401 B2 4/2014 Makarov et al.
8,695,157 B2 4/2014 Beskow et al.
8,713,751 B2 5/2014 Conrad
8,713,754 B2 5/2014 Conrad
8,739,357 B2 6/2014 Conrad
8,739,359 B2 6/2014 Conrad
8,752,239 B2 6/2014 Conrad
8,763,202 B2 7/2014 Conrad
8,769,767 B2 * 7/2014 Conrad ..... A47L 5/36 15/327.1
8,776,309 B2 7/2014 Conrad
8,813,305 B2 8/2014 Conrad
8,869,344 B2 10/2014 Conrad
9,775,483 B2 * 10/2017 Rukavina ..... A47L 9/1608
2002/0011050 A1 1/2002 Hansen et al.
2002/0134059 A1 9/2002 Oh
2003/0159235 A1 8/2003 Oh
2003/0159411 A1 8/2003 Hansen et al.
2003/0200734 A1 10/2003 Conrad
2004/0098827 A1 5/2004 Oh
2004/0098828 A1 5/2004 Oh
2004/0107530 A1 6/2004 Lee
2004/0134025 A1 7/2004 Murphy et al.
2004/0163206 A1 8/2004 Oh
2004/0194250 A1 10/2004 Conrad et al.
2004/0231093 A1 11/2004 Oh
2005/0066469 A1 3/2005 Oh et al.
2005/0125940 A1 6/2005 McDowell
2005/0177974 A1 8/2005 Conrad et al.
2005/0198769 A1 9/2005 Lee et al.
2005/0262658 A1 12/2005 Conrad et al.
2006/0075727 A1 4/2006 Kim et al.
2006/0090290 A1 5/2006 Lau
2006/0102005 A1 5/2006 Oh
2006/0117721 A1 6/2006 Lee
2006/0117723 A1 6/2006 Yoo
2006/0130265 A1 6/2006 Oh et al.
2006/0130447 A1 6/2006 Seo et al.
2006/0130448 A1 6/2006 Han et al.
2006/0130449 A1 6/2006 Han
2006/0137310 A1 6/2006 Conrad et al.
2006/0230722 A1 10/2006 Oh et al.
2006/0254226 A1 11/2006 Jeon
2006/0272299 A1 12/2006 Choi
2006/0288671 A1 12/2006 Oh et al.
2007/0039292 A1 2/2007 Oh
2007/0079584 A1 4/2007 Kim
2007/0079586 A1 4/2007 Kim
2007/0084159 A1 4/2007 Oh et al.
2007/0084160 A1 4/2007 Kim
2007/0119129 A1 5/2007 Jeon
2007/0144116 A1 6/2007 Hong et al.
2007/0175185 A1 8/2007 Kim et al.
2007/0209334 A1 9/2007 Conrad
2007/0214754 A1 9/2007 Kim
2007/0234687 A1 10/2007 Ni

(56) References Cited

U.S. PATENT DOCUMENTS

| | | | |
|---|---|---|---|
| 2007/0234691 | A1 | 10/2007 | Han et al. |
| 2008/0196194 | A1 | 8/2008 | Conrad |
| 2008/0263813 | A1 | 10/2008 | Han et al. |
| 2008/0263815 | A1 | 10/2008 | Oh |
| 2008/0264014 | A1 | 10/2008 | Oh et al. |
| 2008/0289139 | A1 | 11/2008 | Makarov et al. |
| 2008/0289140 | A1 | 11/2008 | Courtney et al. |
| 2008/0289306 | A1 | 11/2008 | Han et al. |
| 2009/0144932 | A1 | 6/2009 | Yoo |
| 2009/0193613 | A1 | 8/2009 | Ruben et al. |
| 2009/0205161 | A1 | 8/2009 | Conrad |
| 2009/0229071 | A1 | 9/2009 | Fester et al. |
| 2009/0229074 | A1 | 9/2009 | Oh |
| 2009/0235482 | A1 | 9/2009 | Tanner et al. |
| 2009/0300871 | A1 | 12/2009 | Seo et al. |
| 2009/0313958 | A1 | 12/2009 | Gomiciaga-Pereda et al. |
| 2010/0043170 | A1 | 2/2010 | Ni |
| 2010/0115727 | A1 | 5/2010 | Oh |
| 2010/0162517 | A1 | 7/2010 | Han et al. |
| 2010/0175217 | A1 | 7/2010 | Conrad |
| 2010/0192776 | A1 | 8/2010 | Oh et al. |
| 2010/0223752 | A1 | 9/2010 | Conrad |
| 2010/0229323 | A1 | 9/2010 | Conrad |
| 2010/0229325 | A1 | 9/2010 | Conrad |
| 2010/0229328 | A1 | 9/2010 | Conrad |
| 2010/0229330 | A1 | 9/2010 | Park et al. |
| 2010/0229334 | A1 | 9/2010 | Conrad |
| 2010/0251506 | A1 | 10/2010 | Conrad |
| 2010/0269289 | A1 | 10/2010 | Ruben |
| 2010/0299865 | A1 | 12/2010 | Conrad |
| 2010/0299866 | A1 | 12/2010 | Conrad |
| 2011/0146024 | A1 | 6/2011 | Conrad |
| 2011/0214247 | A1 | 9/2011 | Stephens et al. |
| 2011/0219576 | A1 | 9/2011 | Conrad |
| 2011/0219577 | A1 | 9/2011 | Conrad |
| 2011/0240526 | A1 | 10/2011 | Tammera et al. |
| 2011/0289720 | A1 | 12/2011 | Han et al. |
| 2011/0296648 | A1 | 12/2011 | Kah, Jr. |
| 2011/0314631 | A1 | 12/2011 | Conrad |
| 2012/0047682 | A1 | 3/2012 | Makarov et al. |
| 2012/0117753 | A1 | 5/2012 | Kim et al. |
| 2012/0216368 | A1 | 8/2012 | Maeda et al. |
| 2012/0222232 | A1 | 9/2012 | Conrad |
| 2012/0222238 | A1 | 9/2012 | Conrad |
| 2012/0222240 | A1 | 9/2012 | Conrad |
| 2012/0222243 | A1 | 9/2012 | Conrad |
| 2012/0222247 | A1 | 9/2012 | Conrad |
| 2012/0222248 | A1 | 9/2012 | Conrad |
| 2012/0222252 | A1 | 9/2012 | Conrad |
| 2012/0222253 | A1 | 9/2012 | Conrad |
| 2012/0222255 | A1 | 9/2012 | Conrad |
| 2012/0222257 | A1 | 9/2012 | Conrad |
| 2012/0222258 | A1 | 9/2012 | Conrad |
| 2012/0222262 | A1 | 9/2012 | Conrad |
| 2012/0311814 | A1 | 12/2012 | Kah, Jr. |
| 2013/0008140 | A1 | 1/2013 | Pike et al. |
| 2013/0145575 | A1 | 6/2013 | Conrad |
| 2013/0185893 | A1 | 7/2013 | Conrad |
| 2014/0013538 | A1 | 1/2014 | Dyson et al. |
| 2014/0013540 | A1 | 1/2014 | Erko et al. |
| 2014/0020203 | A1 | 1/2014 | Miefalk et al. |
| 2014/0026356 | A1 | 1/2014 | Miefalk et al. |
| 2014/0053367 | A1 | 2/2014 | Conrad |
| 2014/0059797 | A1 | 3/2014 | Kim et al. |
| 2014/0059799 | A1 | 3/2014 | Kim et al. |
| 2014/0082883 | A1* | 3/2014 | Tran ..... A47L 9/1633 15/353 |
| 2015/0000072 | A1 | 1/2015 | Conrad |
| 2015/0000073 | A1 | 1/2015 | Conrad |
| 2015/0000074 | A1 | 1/2015 | Conrad |
| 2015/0000075 | A1 | 1/2015 | Conrad |
| 2015/0000076 | A1 | 1/2015 | Conrad |
| 2015/0000077 | A1 | 1/2015 | Conrad |
| 2015/0000078 | A1 | 1/2015 | Conrad |
| 2015/0000079 | A1 | 1/2015 | Conrad |
| 2015/0230677 | A1* | 8/2015 | Andrikanish ..... A47L 9/102 15/353 |
| 2016/0113461 | A1* | 4/2016 | Rukavina ..... A47L 9/1608 15/353 |

FOREIGN PATENT DOCUMENTS

| | | |
|---|---|---|
| DE | 102005056924 | 5/2007 |
| EP | 1690487 | 8/2006 |
| JP | 2002085297 | 3/2002 |
| JP | 2002143052 | 5/2002 |
| JP | 2004024887 | 1/2004 |
| JP | 2004089241 | 3/2004 |
| JP | 2004313249 | 11/2004 |
| JP | 2004351234 | 12/2004 |
| JP | 2005270312 | 10/2005 |
| WO | 2014/044541 | 4/2010 |

* cited by examiner

HANDHELD VACUUM CLEANER

CROSS-REFERENCE TO RELATED APPLICATIONS

This application claims priority to U.S. Provisional Patent Application No. 62/067,308, filed on Oct. 22, 2014, the contents of which are hereby incorporated by reference in its entirety.

BACKGROUND

The present invention relates to handheld vacuum cleaners, and more particularly, to cyclonic handheld vacuum cleaners.

SUMMARY

In one embodiment, the invention provides a handheld vacuum cleaner including a housing having a front end, a back end, a first side, and a second side, a suction nozzle, and a suction source operable to generate an airflow through vacuum cleaner from the suction nozzle through a cyclonic separator to a clean air exhaust. The cyclonic separator is operable to separate debris from the airflow. The cyclonic separator is located within the housing. The cyclonic separator includes a cylindrical wall having a first end and a second end, a first end wall located at the first end of the cylindrical wall, a dirty air inlet, a clean air outlet, a debris outlet adjacent the second end of the cylindrical wall, and a longitudinal axis along the cylindrical wall and the longitudinal axis of the cyclonic separator extends in a direction toward the first and second sides of the housing. The vacuum further includes a debris collection chamber located within the housing and in fluid communication with the debris outlet of the cyclonic separator. The housing further includes an aperture that extends through the first side. The first end wall of the cyclonic separator is removable through the aperture of the first side of the housing.

In another embodiment, the invention provides a handheld vacuum cleaner including a housing with a handle and a suction source operable to generate an airflow through the handheld vacuum cleaner from a suction nozzle through a cyclonic separator to a clean air exhaust. The cyclonic separator includes a cylindrical wall having a first end and a second end, a first end wall located at the first end of the cylindrical wall, a dirty air inlet, and a clean air outlet in the first end wall. The cyclonic separator is in a horizontal orientation, and the first end wall of the cyclonic separator is openable.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
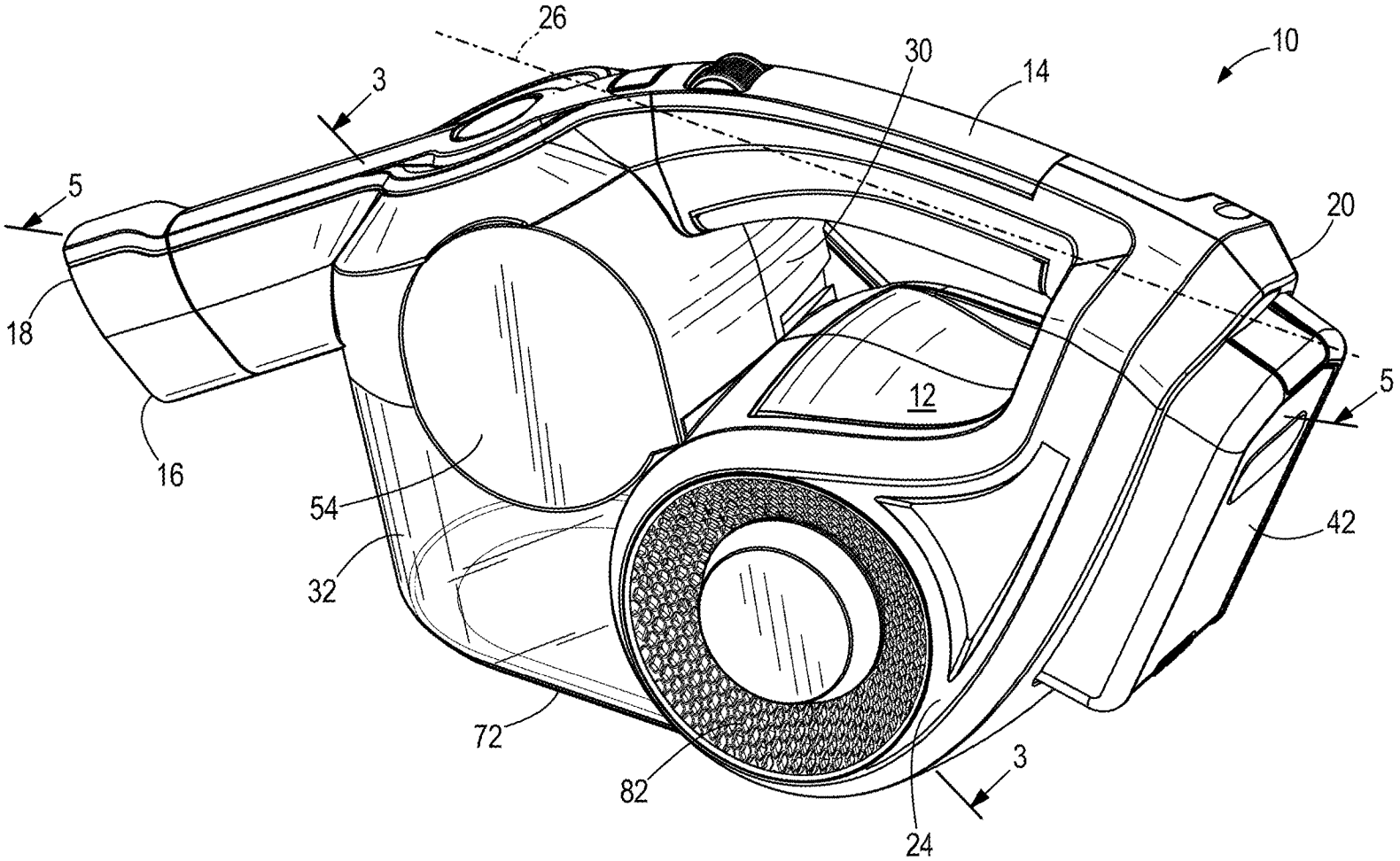
FIG. 1 is a perspective view of a handheld vacuum cleaner according to an embodiment of the invention.
Figure 2:
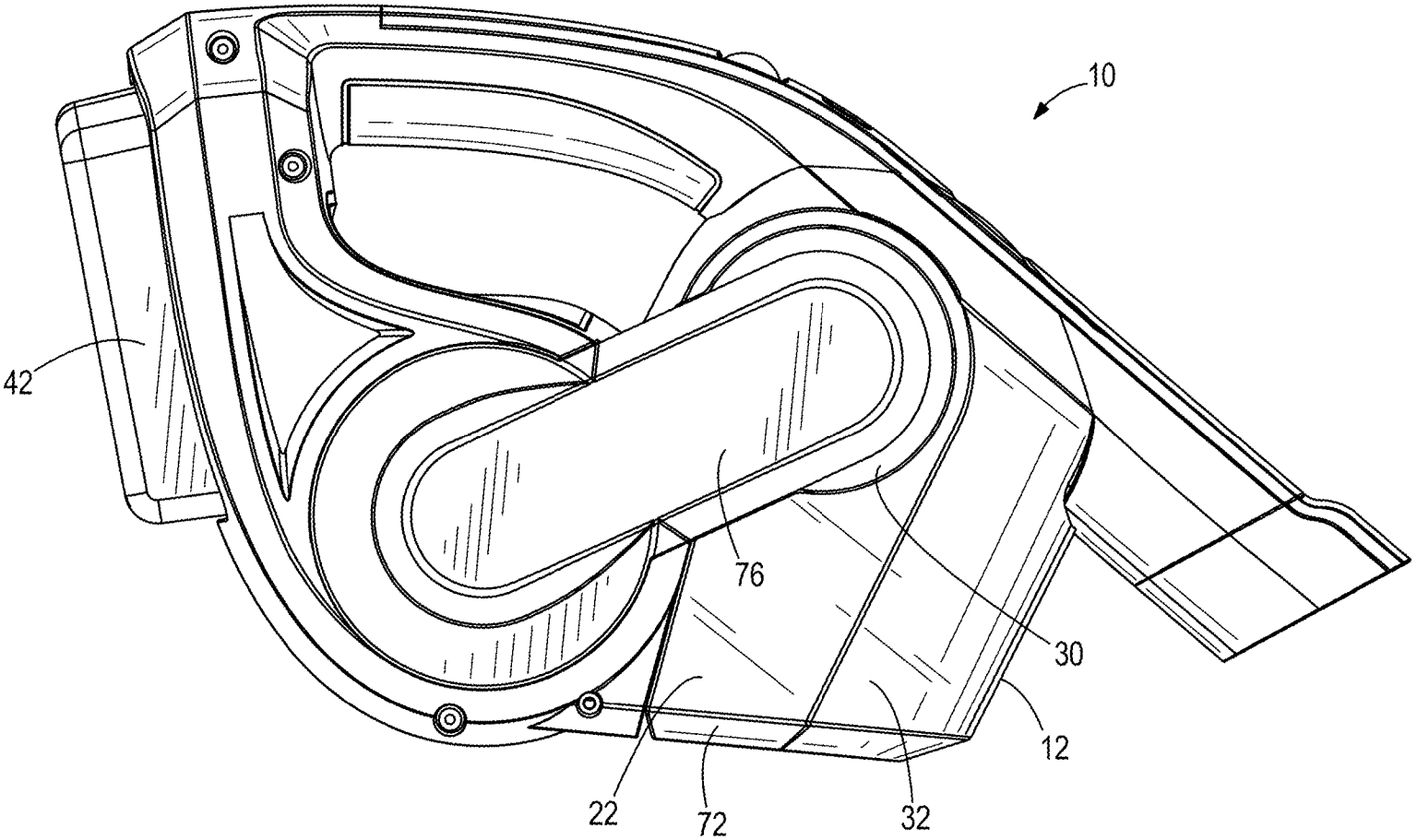
FIG. 2 is an alternative perspective view of the vacuum cleaner of FIG. 1.

FIGS. 1 and 2 illustrate a handheld vacuum cleaner 10. The vacuum cleaner 10 includes a housing 12, a handle 14, and a suction nozzle 16. The housing 12 includes a front end 18, a back end 20, a first side 22, and a second side 24. The suction nozzle 16 is located at the front end 18 of the housing 12. The handle 14 may be located at the top of the housing 12, and in some embodiments, the handle 14 defines a longitudinal axis 26 that extends generally in a front-to-back direction along the housing 12. Other handle arrangements may be configured as desired for the application.

Figure 3:
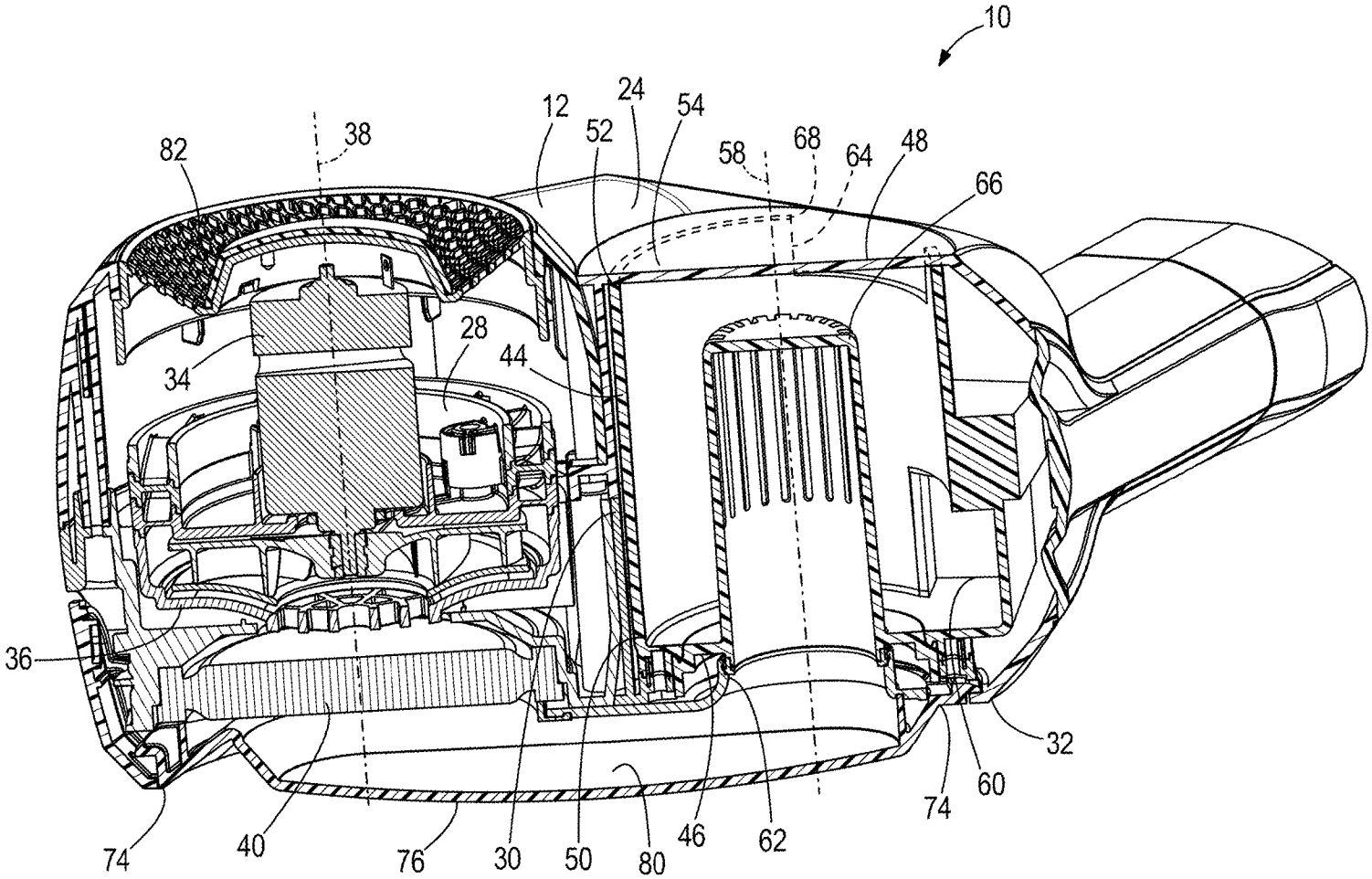
FIG. 3 is a cross-sectional view of the vacuum cleaner of FIG. 1 taken along lines 3-3 shown in FIG. 1.
Figure 4:
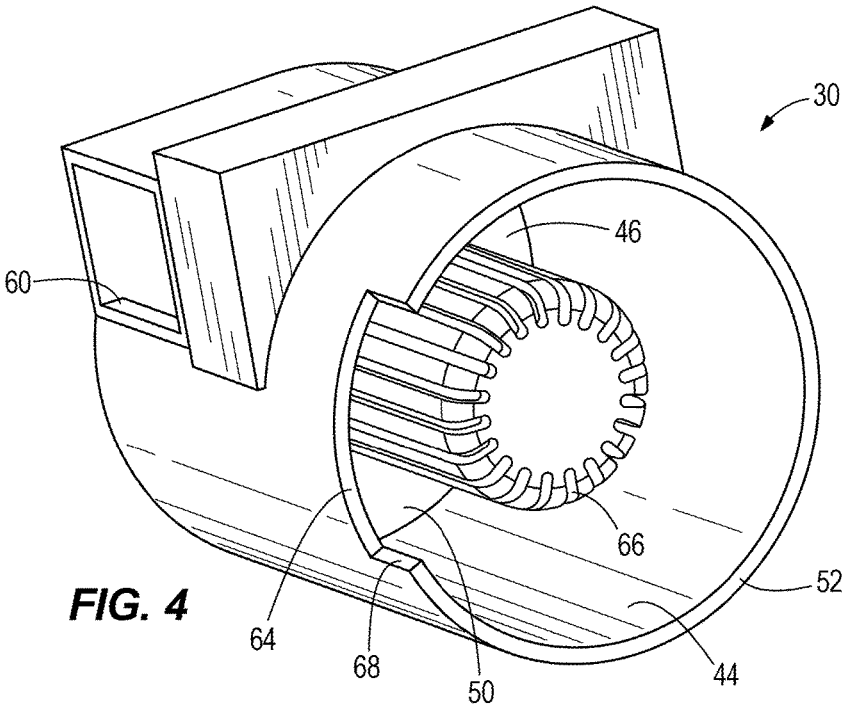
FIG. 4 is a perspective view of a cyclonic separator of the vacuum cleaner of FIG. 1.
Figure 5:
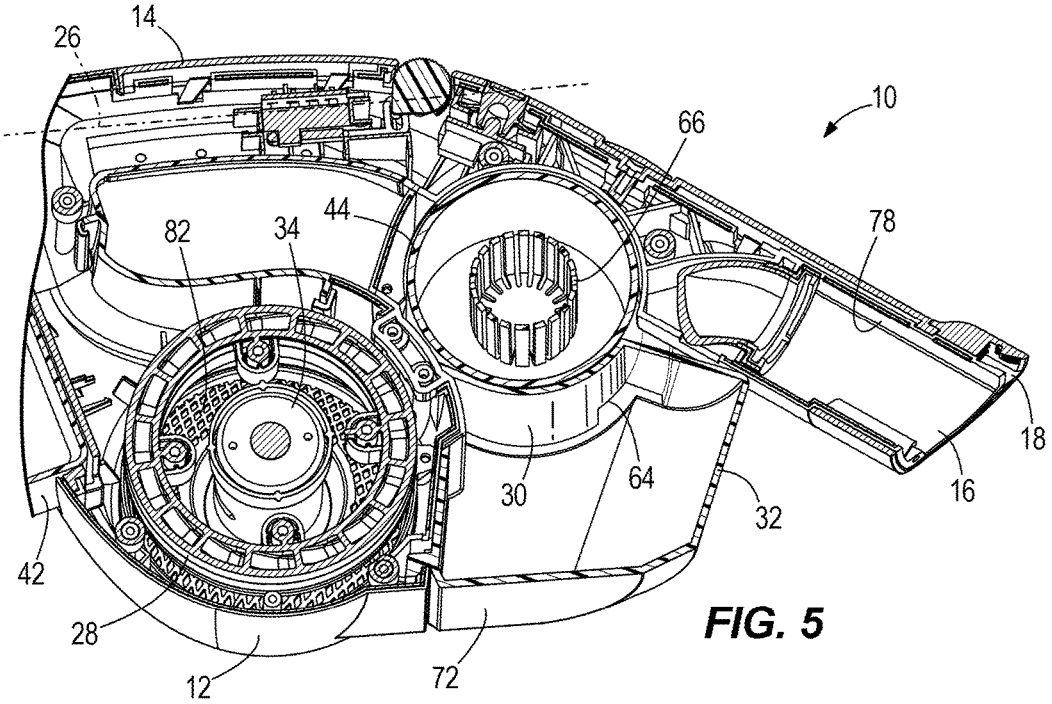
FIG. 5 is an alternative cross-sectional view of the vacuum cleaner of FIG. 1 taken along lines 5-5 shown in FIG. 1.

Referring to FIGS. 3-5, the vacuum cleaner 10 further includes a suction source 28, a cyclonic separator 30, and a dirt collection chamber 32. The suction source 28 is located in the housing 12 and includes a motor 34 and a fan 36 operable to generate a suction airflow through the vacuum cleaner that is drawn from the suction nozzle 16 through the cyclonic separator 30 to a clean air exhaust 82. The motor 34 includes a motor axis 38 (FIG. 3) and the motor 34 is operable to rotate the fan 36 about the motor axis 38. In the illustrated embodiment, the motor 34 and the fan 36 are orientated such that the motor axis 38 extends in a direction toward the first and second sides 22, 24 of the housing 12 and therefore, the motor axis 38 is generally horizontal when the vacuum 10 is in use. Alternatively, the motor axis may extend in a generally front-to-back direction along the housing. A premotor filter 40 is also located in the housing 12 in a filter chamber on or adjacent the first side of the housing and the filter 40 filters the airflow before traveling through the motor 34 and fan 36. The illustrated vacuum 10 includes a battery 42 that supplies power to the suction source 28 to operate the motor 34. Alternatively or additionally, the vacuum may include a power cord for supplying power from a household electrical outlet (not shown).

The cyclonic separator 30 includes a cylindrical wall 44, a first end wall 46, and a second end wall 48. The cylindrical wall 44 includes a first end 50 and a second end 52. The first end wall 46 is located at the first end 50 of the cylindrical wall 44. In one embodiment, the first end wall 46 is removably coupled to the cylindrical wall 44 so that the cyclonic separator 30 can be cleaned, which will be discussed in more detail below. The second end wall 48 is located at the second end 52 of the cylindrical wall 44. As shown in the illustrated embodiment, the second end wall 48 is formed by a portion 54 of the second side 24 of the housing 12. Optionally, an access door may be provided on the second side 24 of the housing for access to the inside of the cyclone. The cyclonic separator 30 includes a longitudinal axis 58 (FIG. 3) that is along or surrounded by the cylindrical wall 44. The axis 58 extends in a direction toward the first and second sides 22, 24 of the housing 12. In the illustrated embodiment, the longitudinal axis 58 of the cyclonic separator 30 is approximately parallel to the motor axis 38 and therefore, the cyclonic separator 50 is also in a generally horizontal orientation.

As used in the present description and claims, a generally horizontal orientation means an orientation that is tilted over such that it is not vertical or upright. The generally horizontal orientation includes in various embodiments that are approximately parallel to the ground or floor, as well as orientations that are not parallel to the ground or floor but being generally more laying over than upright, i.e. being tilted more than about 45 degrees. In the illustrated embodiment, the suction source is adjacent the cyclonic separator in generally a side-by-side arrangement. In other embodiments (not shown), the motor axis may extend in a generally front-to-back direction along the housing such that the motor axis is generally perpendicular to the longitudinal axis of the cyclonic separator.

The cyclonic separator 30 further includes a dirty air inlet 60, a clean air outlet 62, and a debris outlet 64. The dirty air inlet 60 is adjacent the first end 50 of the cylindrical wall 44 and extends through the cylindrical wall 44. The clean air outlet 62 is also adjacent the first end 50 of the cylindrical wall 44. More specifically, in the illustrated embodiment, the clean air outlet 62 is formed in the first end wall 46. The illustrated cyclonic separator 30 includes a perforated tube 66 located within the cylindrical wall 44 that forms the clean air outlet 62. The perforated tube 66 extends from the first end wall 46. The perforated tube 70 may be perforated using holes, slots, screen, mesh, or other perforation. In the illustrated embodiment, an airflow passageway 80 (i.e., duct) (FIG. 3) is positioned along the first side 22 of the housing 12 from the clean air outlet 62 to the filter chamber. In other words, the passageway 80 fluidly communicates the clean air outlet 62 with the premotor filter 40. The debris outlet 64 is adjacent the second end 52 of the cylindrical wall 44 between the second end 52 of the wall 44 and the second end wall 48. In the illustrated embodiment, the wall 44 includes a notch 68 that partially defines the debris outlet 64.

The vacuum cleaner 10 further includes the dirt collection chamber 32 located within the housing 12 and in fluid communication with the debris outlet 64 of the cyclonic separator 30. The dirt collection chamber 32 is generally located adjacent the cyclonic separator 30 and may be in front of the suction source 28. In the illustrated embodiment, the dirt collection chamber 32 is adjacent the suction source, and may be positioned so that the dirt collection chamber 32 does not extend between the first end wall 46 and the first side 22. Additionally, in the embodiment shown in FIG. 5, the cyclone separator is positioned in the housing such that the debris collection chamber is bounded by the separator so that air does not circulate around the outside diameter of the cyclone. A dirt collector door 72 is removably coupled to the housing to facilitate emptying the debris collection chamber 32.

Referring to the embodiment in FIGS. 2 and 3, the housing 12 may further include an aperture 74 located on the first side 22 of the housing 12. A door 76 is coupled to the first side 22 of the housing 12 to cover the aperture 74. The door 76 can be opened by the user to permit access to the suction source 28 and premotor filter 40. Optionally, the door 76 can be opened to permit access the cyclonic separator 30. In other embodiments, a first door may be provided to access the premotor filter 40 and a second door may be provided to permit access to the cyclonic separator 30 and the aperture 74. In the illustrated embodiment, at least a portion of the door 76 defines the duct 80 that provides fluid communication between the cyclonic separator 30 and the filter chamber and the suction source 28.

Figure 6:
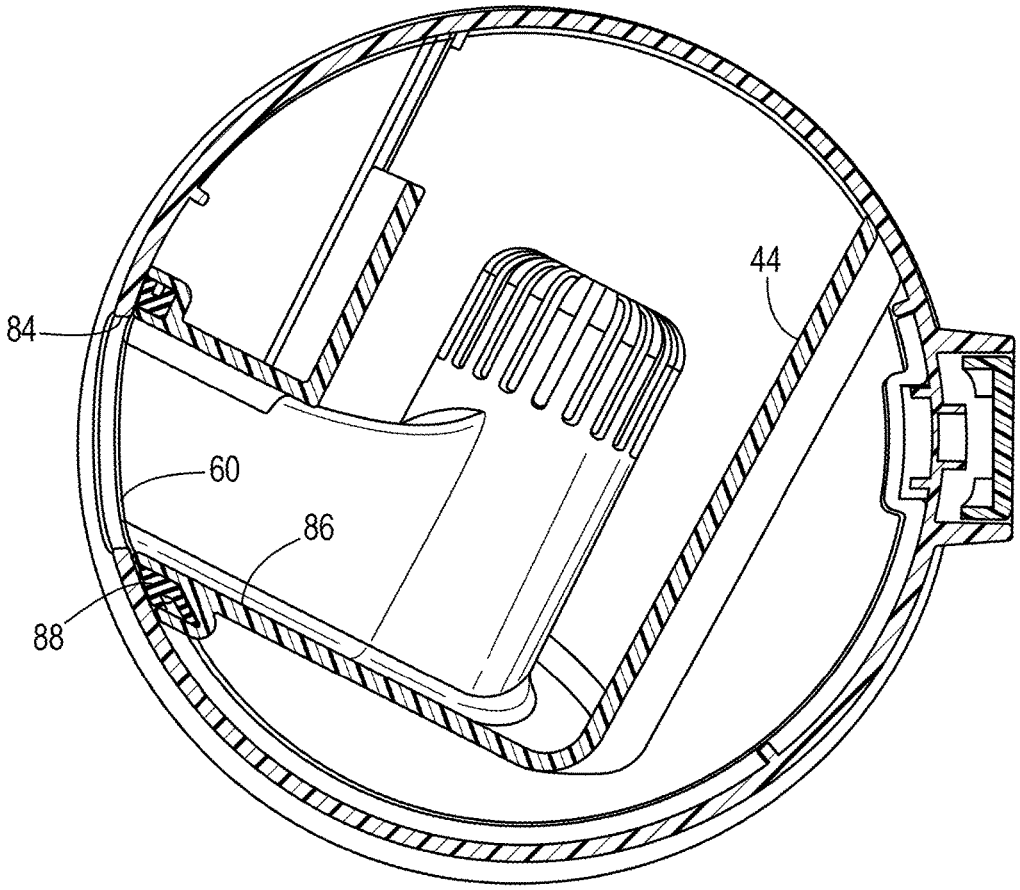
FIG. 6 is a cross-sectional view of a cyclonic separator of the vacuum cleaner.

In one embodiment, referring to FIGS. 4-6, the housing 12 includes an inlet aperture 84 through the housing wall and the dirty air inlet 60 includes a passageway 86 between the inlet aperture 84 and the cylindrical wall 44 (FIG. 6). The cyclonic separator 30 has a seal 88 positioned between the passageway 86 and the housing 12 around the inlet aperture 84 on an inside surface of the housing 12. The seal 88 may be attached to the cyclonic separator 30 or the seal 88 may be attached to the wall of the housing 12. In another embodiment, the seal 88 seals the interface between the passageway 86 and an inlet duct 78 that is between the suction nozzle 16 and the passageway 86.

In operation, the power cord or battery 42 provides power to the motor 34 to rotate the fan 36 to generate a suction airflow that is drawn through the suction nozzle 16 along with debris. The airflow, entrained with debris, travels along the inlet duct 78 to the dirty air inlet 60 of the cyclonic separator 30. The airflow and debris travel into the cylindrical wall 44 where the airflow and debris rotate about the longitudinal axis 58. Rotation of the airflow and debris causes the debris to separate from the airflow and the debris is discharged over the cylindrical wall 44 through debris outlet 64. The separated debris falls into the debris collection chamber 32. The clean air travels through the perforated tube 66 forming the clean air outlet 62 of the cyclonic separator 30. The clean airflow then travels through the duct 80 formed by the door 76 to the suction source 28. The airflow travels through the premotor filter 40 before traveling through the suction source 28. After traveling through the suction source 28, the airflow is exhausted from the vacuum cleaner 10 through exhaust openings 82 in the second side 24 of the housing 12.

After using the vacuum 10, the user can open the dirt collector door 72 to empty the debris collection chamber 32. After several uses, debris may collect on the perforated tube 66 and within the cylindrical wall 44. If so, the user can open the door 76 and remove the first end wall 46 and perforated tube 66 from the cylindrical wall 44 through the aperture 74. This allows the user to clean the perforated tube 66 and inside the wall 44. Opening the door 76 also provides the user access to the premotor filter 40 and the passageway 80, such that the user can clean or replace the premotor filter 40.

Various features and advantages of the invention are set forth in the following claims.

What is claimed is:

1. A handheld vacuum cleaner comprising:

a housing having a front end, a back end, a first side, and a second side;

a suction nozzle;

a suction source operable to generate an airflow through the vacuum cleaner from the suction nozzle through a cyclonic separator to a clean air exhaust;

the cyclonic separator operable to separate debris from the airflow, the cyclonic separator located within the housing, the cyclonic separator including, a cylindrical wall having a first end and a second end, a first end wall located at the first end of the cylindrical wall, a dirty air inlet, a clean air outlet, a debris outlet adjacent the second end of the cylindrical wall, a longitudinal axis along the cylindrical wall and the longitudinal axis of the cyclonic separator extends in a direction toward the first and second sides of the housing; and a debris collection chamber located within the housing and in fluid communication with the debris outlet of the cyclonic separator;

wherein the housing includes an aperture that extends through the first side, and wherein the first end wall of the cyclonic separator is removable through the aperture of the first side of the housing.

2. The handheld vacuum cleaner of claim 1, wherein the dirty air inlet is adjacent the first end of the cylindrical wall.

3. The handheld vacuum cleaner of claim 2, wherein the dirty air inlet extends through the cylindrical wall.

4. The handheld vacuum cleaner of claim 2, wherein the clean air outlet is adjacent the first end of the cylindrical wall.

5. The handheld vacuum cleaner of claim 4, further comprising a perforated tube located within the cylindrical wall.

6. The handheld vacuum cleaner of claim 1, wherein the clean air outlet extends through the first end wall of the cyclonic separator.

7. The handheld vacuum cleaner of claim 6, wherein the second side of the housing forms a second end wall of the cyclonic separator located at the second end of the cylindrical wall.

8. The handheld vacuum cleaner of claim 7, wherein the debris outlet is adjacent the second end wall and the second end wall defines a portion of the debris outlet.

9. The handheld vacuum cleaner of claim 8, wherein at least a portion of the first end wall is removable from the cylindrical wall.

10. The handheld vacuum cleaner of claim 9, further comprising a perforated tube located within the cylindrical wall, the perforated tube extending from the first end wall of the cyclonic separator forming the clean air outlet, and wherein the perforated tube is removable with the first end wall through the aperture of the first side of the housing.

11. The handheld vacuum cleaner of claim 9, wherein the suction source is located within the housing, the handheld vacuum cleaner further comprising a door coupled to the first side of the housing, the door movable relative to the housing to permit access to a filter chamber on or adjacent the first side of the housing, and optionally to permit access to the first end wall to remove the first end wall through the aperture of the first side of the housing.

12. The handheld vacuum cleaner of claim 11, further comprising an airflow passageway along the first side of the housing from the clean air outlet to the filter chamber.

13. The handheld vacuum cleaner of claim 11, wherein the door defines a duct that provides fluid communication between the cyclonic separator and the suction source.

14. The handheld vacuum cleaner of claim 1, wherein the suction source is located within the housing, the handheld vacuum cleaner further comprising a door coupled to the first side of the housing, the door movable relative to the housing to permit access to a filter chamber on or adjacent the first side of the housing.

15. The handheld vacuum cleaner of claim 14, further comprising a premotor filter in the filter chamber configured to filter debris in the airflow traveling from the cyclonic separator to the suction source, the door movable relative to the housing to permit access to the premotor filter.

16. The handheld vacuum cleaner of claim 1, further comprising a debris collection chamber door removably coupled to the housing to facilitate emptying debris from the debris collection chamber.

17. The handheld vacuum cleaner of claim 1, wherein the suction source includes a fan and a motor operable to rotate the fan about a motor axis, and wherein the motor axis extends in a direction toward the first and second sides of the housing.

18. The handheld vacuum cleaner of claim 17, wherein the motor axis is generally parallel to the longitudinal axis of the cyclonic separator.

19. The handheld vacuum cleaner of claim 18, where the suction source is adjacent the cyclonic separator in generally a side-by-side arrangement and the debris collection chamber is adjacent the cyclonic separator.

20. The handheld vacuum cleaner of claim 19, where the suction source is adjacent the debris collection chamber.

21. The handheld vacuum cleaner of claim 18, further comprising a battery that supplies power to the suction source, the battery removably coupled to the back end of the housing.

22. The handheld vacuum cleaner of claim 1, wherein the suction source includes a fan and a motor operable to rotate the fan about a motor axis, and wherein the motor axis is generally perpendicular to the longitudinal axis of the cyclonic separator.

23. The handheld vacuum cleaner of claim 22, where the suction source is adjacent the cyclonic separator and the debris collection chamber is adjacent the cyclonic separator.

24. The handheld vacuum cleaner of claim 23, where the suction source is adjacent the debris collection chamber.

25. The handheld vacuum cleaner of claim 1, wherein the suction nozzle is adjacent the front end of the housing.

26. The handheld vacuum cleaner of claim 1, wherein the housing includes an inlet aperture through the housing wall and the dirty air inlet includes a passageway between the inlet aperture and the cylindrical wall, the cyclonic separator including a first seal between the passageway and the housing around the inlet aperture on an inside surface of the housing.

27. A handheld vacuum cleaner comprising:

a housing including a handle and a suction source operable to generate an airflow through the handheld vacuum cleaner from a suction nozzle through a cyclonic separator to a clean air exhaust;

the cyclonic separator including a cylindrical wall having a first end and a second end, a first end wall located at the first end of the cylindrical wall, a dirty air inlet, and a clean air outlet in the first end wall, wherein the cyclonic separator is in a horizontal orientation and the cyclonic separator defines a longitudinal axis that extends in a direction toward a first side and a second side of the housing; and wherein the first end wall of the cyclonic separator is openable.

* * * * *